US007444794B1

(12) United States Patent
Anderson

(10) Patent No.: US 7,444,794 B1
(45) Date of Patent: Nov. 4, 2008

(54) BULGE REDUCER FOR GABLE TOP PACKAGE

(75) Inventor: Paul J. Anderson, Woodbury, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 11/745,908

(22) Filed: May 8, 2007

(51) Int. Cl.
*B65B 1/24* (2006.01)

(52) U.S. Cl. ..... 53/266.1; 53/510; 53/527; 53/529

(58) Field of Classification Search ..... 53/266.1, 53/289, 487, 403, 432, 510, 527, 529; 493/184
See application file for complete search history.

(56) References Cited

U.S. PATENT DOCUMENTS 3,491,803 A * 1/1970 Galik ..... 141/114
3,945,174 A * 3/1976 Franz ..... 53/289
3,973,603 A * 8/1976 Franz ..... 141/114
5,778,639 A * 7/1998 Sireix ..... 53/432
5,809,741 A * 9/1998 Tovey ..... 53/289
5,975,158 A * 11/1999 Gordon et al. ..... 141/114
6,289,654 B1 * 9/2001 Yamaguchi et al. ..... 53/434
6,546,973 B2 * 4/2003 Hattori et al. ..... 141/372

* cited by examiner

*Primary Examiner*—Hemant M Desai
(74) *Attorney, Agent, or Firm*—Levenfeld Pearlstein, LLC

(57) ABSTRACT

A bulge reducer is configured for use on a form, fill and seal packaging machine for gable top packages. The machine has a drive element and plurality of discrete package carriers for conveying the packages along a conveyance path through the machine. The bulge reducer includes a drive member operably connected to the machine station chain. A reciprocating member is operably connected to the drive member for the reciprocation toward and away from the conveyance path. The reciprocating member contacts one of the package side walls as the package moves along the conveyance path to exert an inward force on and urge the side wall inwardly of the package.

14 Claims, 4 Drawing Sheets

BULGE REDUCER FOR GABLE TOP PACKAGE

BACKGROUND OF THE INVENTION

This invention is directed to an apparatus and method for reducing the bulge in a paperboard based carton. More specifically, the invention pertains to an in-line bulge reducer, in a form, fill and seal packaging machine, that contours the middle portions of carton side wall.

Gable top cartons are in widespread use. Such cartons have been known for most of the twentieth century. The characteristic simplicity and widespread acceptance have helped to maintain their popularity as cartons for traditional products, such as liquid food products, for example, milk and juice.

Improvements to gable top cartons continue including improvements in the carton materials. Such improvements are often directed to increasing the effectiveness of the materials to reduce oxygen ingress and flavor loss. As a result of the increased effectiveness of the materials, the overall thickness of the materials can be reduced. This saves material "weight" which provides an overall cost savings.

In addition, in that products are often packaged in process that provide for longer shelf lives and increased product lives, many such cartons are produced in larger sizes. As a result, the cartons tend to appear larger. This may be the result of package bulging, which may not be aesthetically pleasing and may not be acceptable to certain product packagers.

Moreover, many of the process plants use certain downstream equipment, that is equipment downstream of the form, fill and seal machines, that may not accommodate these somewhat larger cartons. As a result, the cartons may require manual handling for these downstream processes and operations.

Accordingly, there is a need for a carton bulge reducer. Desirably, such a bulge reducer can be fitted into existing form, fill and seal machines. More desirably such a bulge reducer operates without additional drives, such as motors. Most desirably, such a bulge reducer applies a force to the carton that increases as along the carton side, toward the center of the carton.

BRIEF SUMMARY OF THE INVENTION

A bulge reducer is configured for use on a form, fill and seal packaging machine for gable top packages. The package has upstanding side walls and a sealed gable top. The machine has a drive element, such as a station chain, and plurality of discrete package carriers for conveying the packages along a conveyance path through the machine.

The bulge reducer includes a drive member operably connected to the machine station chain. A present drive member is a sprocket having petal-like element that engage the station chain.

A reciprocating member is to the drive member for the reciprocation toward and away from the conveyance path. The reciprocating member, preferably a roller, contact one of the package side walls as the packages move along the conveyance path. Contacting the package side wall exert an inward force on and urges the side wall inwardly of the package.

To effect reciprocation of the roller, a cam element is mounted on the sprocket to contact a cam follower on the roller. In this manner, cam element moves the cam element into contact with the follower to reciprocate the roller.

In a present system, the roller is biased away from the conveyance path, as by a spring. A pressure platen is disposed opposite the roller, relative to the conveyance path.

A form, fill and seal packaging machine includes a drive element, such as a station chain, a conveyor operably connected to the chain for moving the cartons through stations of the machine and a carton bulge reducer disposed at a top sealing station. The bulge reducer includes a drive member, such as a sprocket, operably connected to the machine drive element and a reciprocating member, such as a roller, operably connected to the sprocket. A cam on the sprocket urges a cam follower on the roller into the conveyance path. The roller is biased away from the path.

The roller reciprocates toward and away from the conveyance path to contact one of the package side walls as the packages move along the path to exert an inward force on and urge the side wall inwardly of the package when the package is at the top sealing station.

A pressure platen is disposed opposite the reciprocating element relative to the conveyance path. The roller is moved into the conveyance path to reach an inner most extension toward the path substantially corresponding to a central location of a respective carton carrying member.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
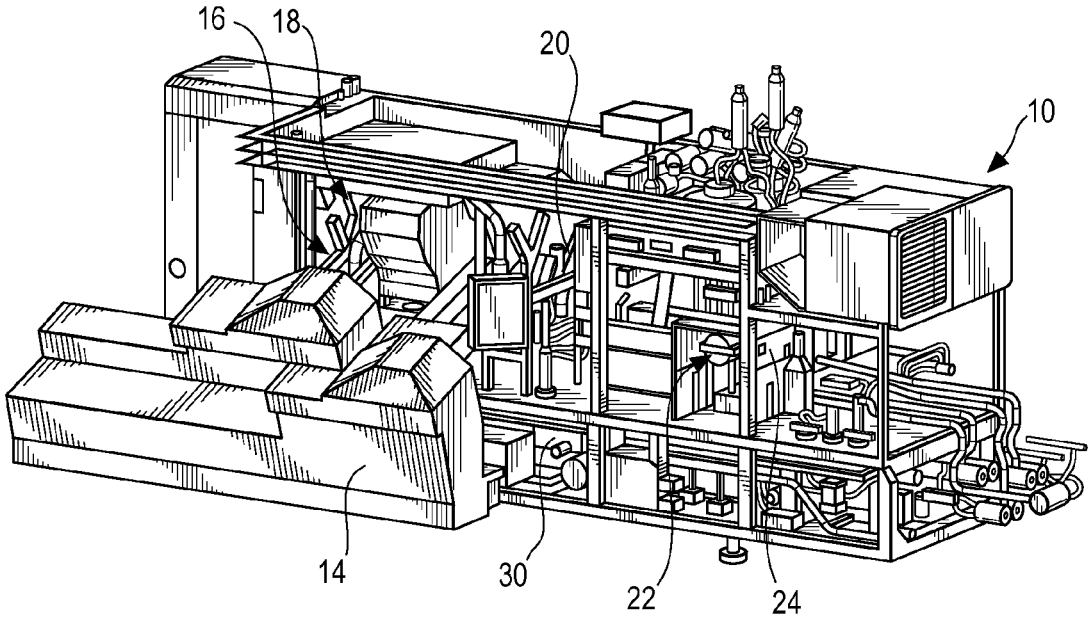
FIG. 1 is a perspective view of a form, fill and seal packaging machine for gable top packages, the machine having a bulge reducer embodying the principles of the present invention.
Figure 2:
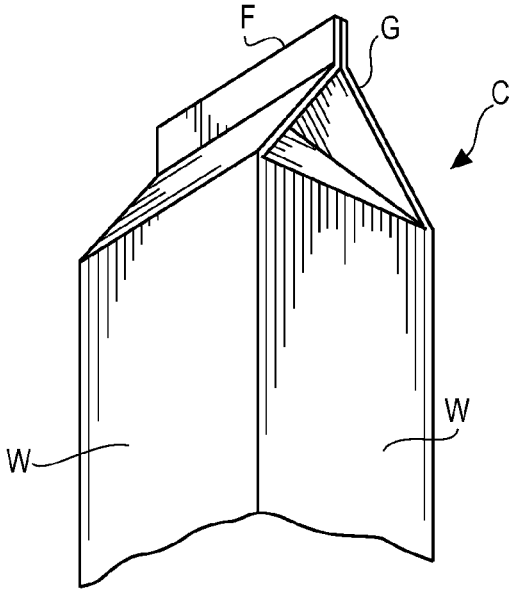
FIG. 2 is a gable top package.
Figure 3:
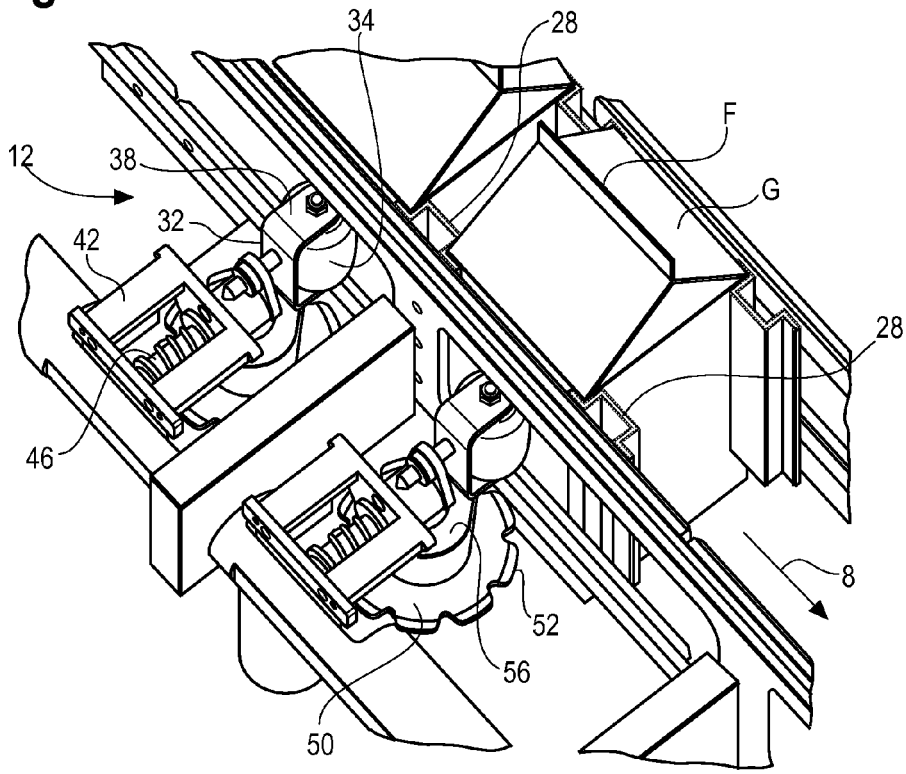
FIG. 3 is top perspective view of the bulge reducer showing cartons in carton carrier in the station chain.
Figure 4:
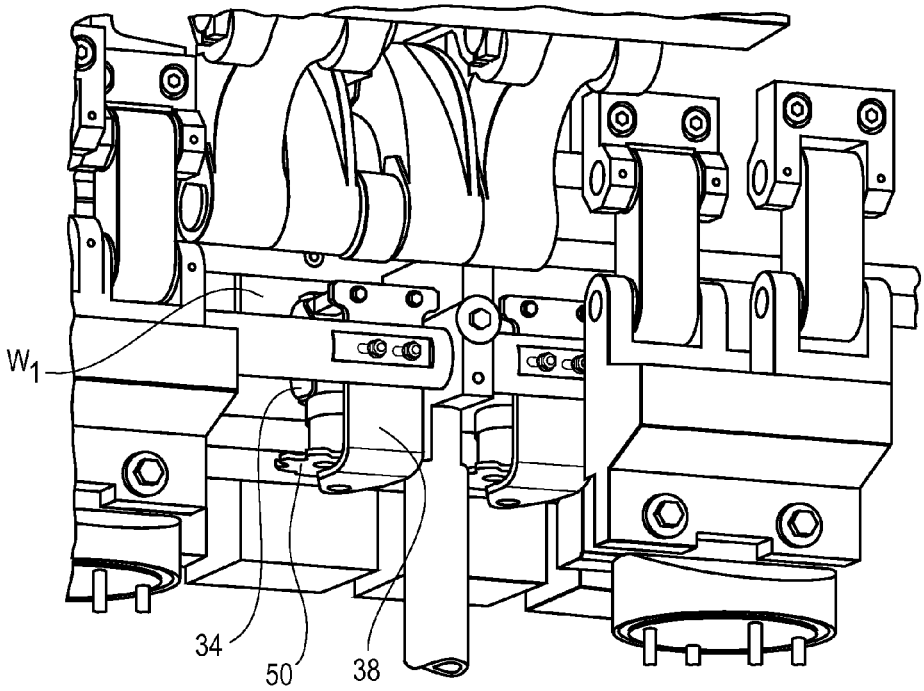
FIG. 4 is a lower plan view of the bulge reducer, showing the mounting to the machine.
Figure 5:
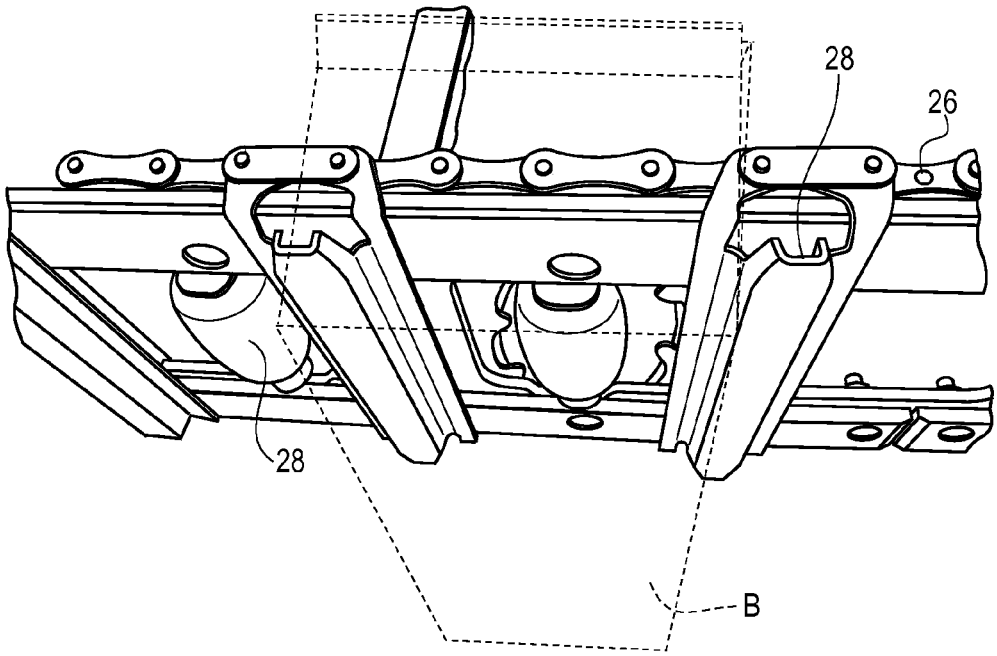
FIG. 5 is a top, inside perspective view of the bulge reducer showing the roller in contact with the carton shown in phantom lines.
Figure 6:
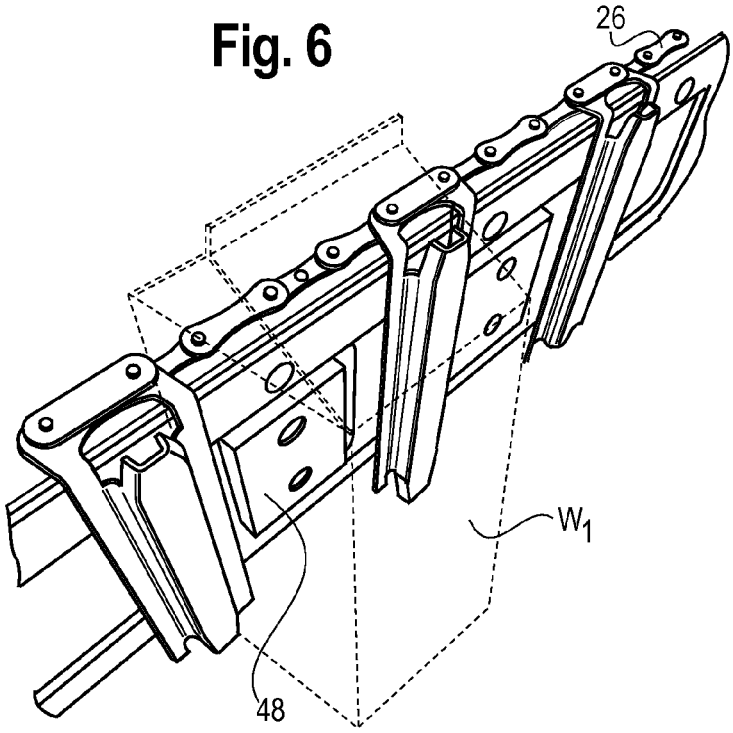
FIG. 6 is a view opposite that of FIG. 5 showing the pressure platen against which the carton bulge reducer is actuated.
Figure 7:
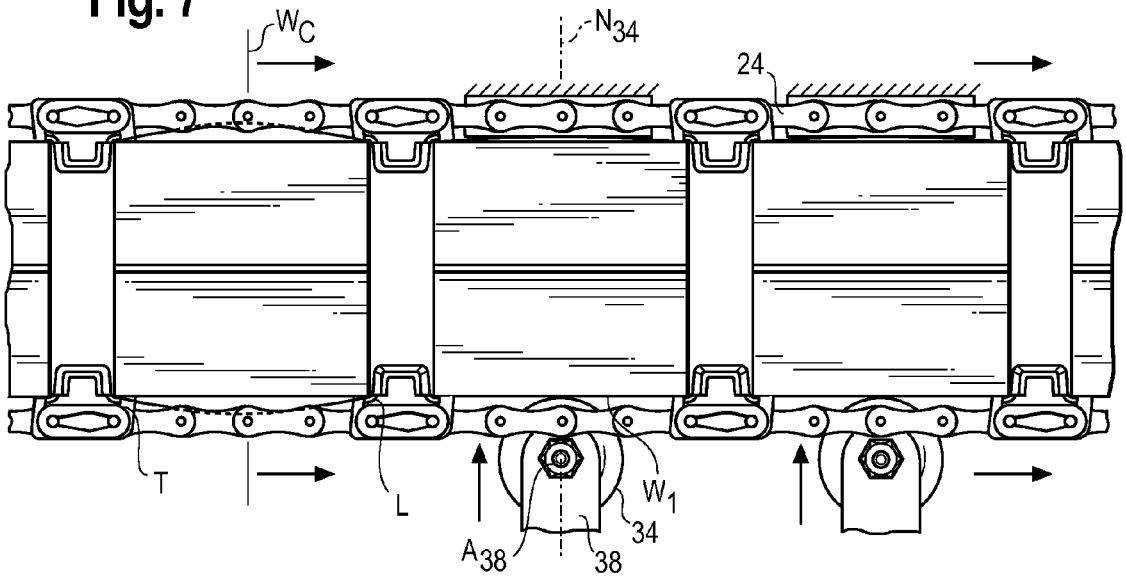
FIG. 7 is a top view of the station chain and the bulge reducer.
Figure 8:
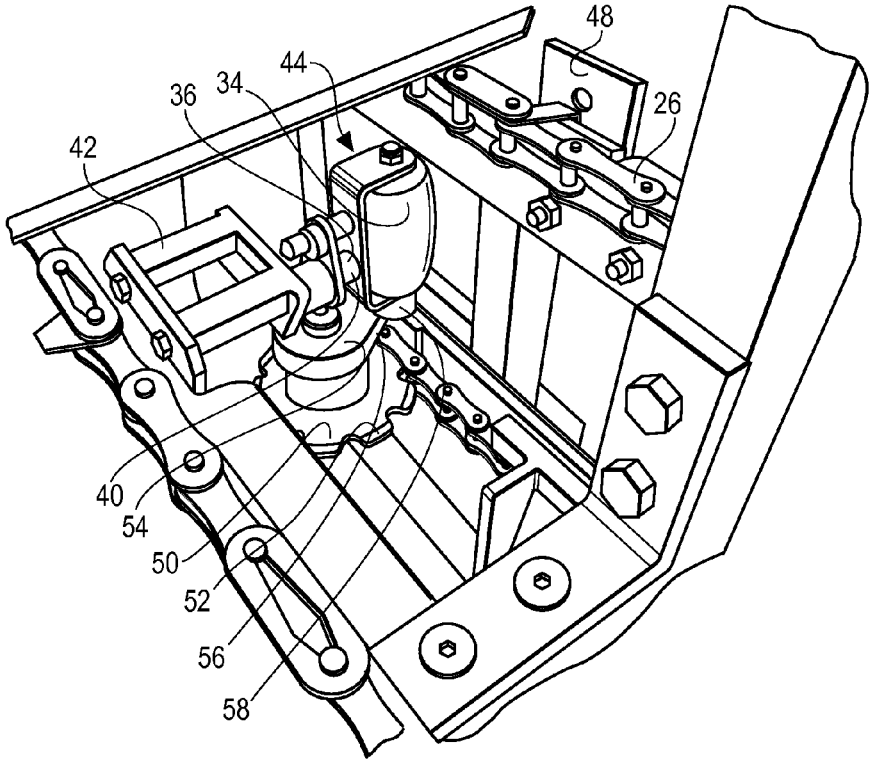
FIG. 8 is a view similar to FIG. 3, showing the sprocket engaged with the station chain.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a form, fill and seal packaging machine 10 having a package bulge reducer 12 embodying the principles of the present invention. The form, fill and seal machine 10 is configured generally to store a series of carton blanks in a flat, folded form, erect the blanks into a tubular form, fold and seal the bottom flaps of the carton, fill and seal the cartons as they move through the machine 10. The form, fill and seal packaging machine 10 can be such as that disclosed in Katsumata, U.S. Pat. No. 6,012,267, which patent is assigned to the assignee of the present invention and is incorporated herein by reference.

To effect the form, fill and seal process, the packaging machine 10 includes a carton magazine 14 for storing the flat, folded carton blanks, a carton erection station 16 and a bottom forming and sealing station 18 to erect the cartons C into a tubular form and to fold and seal the carton bottom B. The machine 10 typically also includes a sterilization station 20 for sterilizing the cartons C and includes a filling station 22 at which the cartons C are filled with product. Following the filling station 22, the carton top panels are folded and sealed at a fin F to form the well recognized gable top G, at a top folding and sealing station 24.

The cartons C are then off loaded from the form, fill and seal packaging machine 10. The packaging machine 10 illustrated includes a conveyor 26 for transporting a series of cartons C to and through each of the stations. In a typical machine 10, the conveyor 26 is a chain-type conveyor that includes a series of carriers or sleeves 28 in which the cartons C are carried. The chain 26 is driven by a drive 30 that also operates or drives other components within the machine 10.

During the form, fill and seal operation, a carton C, having the bottom wall B folded and sealed, and optionally having a closure mounted to the carton and sterilized, is moved in the carrier 28 by the station chain 26 to the filling area 22. At the filling area 22, the carton C is filled with a predetermined volume of product. The filled carton C (with the top still open) is then moved on to the top sealing station 24.

Various types of top sealers are known. One type of top sealer uses a horizontally reciprocating jaw or anvil arrangement. The anvils are mounted to the packaging machine by a pair of pivoting arms such that the movement of the anvils is actually a slight arcuate movement with the anvils contacting the carton in a downward movement portion of the cycle. Such an arrangement is illustrated in Cicha, U.S. Pat. No. 6,430,899, which is commonly assigned with the present application and is incorporated herein by reference. Another type of top sealer includes pivoting arms that move inward to contact and urge the top flaps to close the carton.

In both of these types of top sealers, as the gable G flaps are moved toward one another and the fin F panels are sealed, the gases above the product (in the carton C) and within the walls of the carton C are trapped within the carton C. And, as the carton C is sealed, the volume inside the carton C is slightly reduced. This creates a tendency for the carton C to flex outwardly at the largest surfaces and in particular at the surfaces that are not thickened (such as at seams). This, in effect, results in the large side walls W of the carton C bulging slightly.

The present bulge 12 reducer applies an inward force on a wall $W_1$ of the carton C as the carton C is moved into and is at top sealer 24. The bulge reducer 12 is driven by the station (conveyor drive) chain 26 so that no additional drives, such as motors or the like, are required.

The bulge reducer 12 includes a linearly driven, reciprocating element 32 that is configured to move into contact with the carton C as the carton C moves into the top sealer 24 and such that the maximum travel of the reciprocating element 32 is reached as the top fin F panels are sealed to one another. The reciprocating element 32 includes a roller 34 that is mounted to a reciprocating arm 36 to move into and out of the carton conveyance path P as the carton C is conveyed through the top sealer 24.

The roller 34 is mounted to a U-shaped bracket 38 that supports a shaft 40 positioned in the center of the roller 34, about which the roller 34 rotates. The bracket 38 is mounted to the arm 36 to reciprocate the roller 34 and bracket 38. The arm 36 is mounted for reciprocation in a carriage 42 mounted to the machine 10. The arm 36, bracket 38 and roller 34 (the roller assembly 44) move as a unit relative to the carriage 42. The roller assembly 44 is mounted to the carriage 42 by a biasing element, such as the illustrated coil spring 46, to bias the roller assembly 44 outwardly, away from the carton path P.

A pressure platen 48 is positioned opposite the roller 34, across the carton path P. The platen 48 provides a stationary surface against which the carton C is held as the roller 34 moves into contact with the carton wall W. In this manner, as the roller 34 applies pressure to the wall W, the carton C is "squeezed" between the roller 34 and the platen 48.

The roller assembly 44 has a movement profile so that the roller 34 contacts the carton side wall $W_1$ after the leading corner L has passed the plane $N_{34}$ defined by the axis $A_{34}$ of the roller 34 and moves inward to apply a force on the side wall $W_1$, as the carton side wall center $W_c$ moves toward the axis plane $N_{34}$. In this manner, the maximum inward travel of the roller 34 is at about the center of the carton $W_c$ (and the center of the carton carrier 38). As the center of the carton $W_c$ moves beyond the roller axis plane $N_{34}$, the roller 34 begins to move outward away from the carton C so that the roller 34 no longer contacts the carton C as the trailing edge or corner T of the carton passes the roller $N_{34}$ axis plane.

The present bulge reducer 12 uses the station chain 26 to drive the roller assembly 44 in its reciprocating motion. This has a number of advantages, first of which is that additional or separate drives (such as motors) are not needed to drive the reducer 12. Rather, it is the conveyance movement of the cartons C through the machine 10 that drives the bulge reducer 12. In addition, in that the movement of the bulge reducer 12 directly corresponds to the movement of the cartons C, synchronization of the carton C movement and roller assembly 44 movement is inherent by virtue of the drive arrangement.

In a present bulge reducer 12, a drive wheel 50 is a sprocket having petal-like elements 52 that extend radially outwardly from the wheel 50 to engage the station chain 26. A cam element 54 is mounted to the drive wheel 50. The cam element 54 has a lobe or cam surface 56. The cam element 54 is configured to engage a cam roller or follower 58 that is mounted to the assembly 44. In a present assembly 44, the follower 58 is mounted to the bracket 38, below and aligned with the roller axis $A_{34}$. In this manner as the drive wheel 50 is driven (by the station chain 26), the cam element 54 rotates. In turn, as the cam lobe 56 approaches and contacts the cam follower 58, the lobe 56 exerts a force on the follower 58 which in turn moves reducer roller 34 into contact the with the carton side wall $W_1$. Continued movement of the station chain 26 continues the rotation of the drive wheel 50 and in turn the cam element 54. As the lobe 56 passes the cam follower 58, the biasing element (spring) 46 force returns the roller assembly 44 to the retracted or withdrawn position.

The bulge reducer 12 is timed so that the maximum extension of the roller 34 occurs just as the top sealer 24 is sealing the top fin F panels. It will be appreciated that as the bulge reducer urges 12 the carton side wall $W_1$ inward, the level or height of the liquid in the carton C will rise. This is due to the reduced volume of the carton C with the wall $W_1$ urged inward. When the volume is reduced (and consequently the liquid height is increased) and the top fin F panels are sealed, a lower pressure region is created above the liquid in the sealed carton C when the liquid returns to its level in an at rest carton C. By lower pressure, it can simply be a lesser pressure than would otherwise occur when the fin F panels are sealed with the entrapped gases above the liquid. As a result, the walls of the carton tend to be drawn inward by the lower pressure, rather than bulge outward by a slightly pressurized region above the liquid.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bulge reducer for a gable top package that is formed, filled and sealed on a form, fill and seal packaging machine, the package having upstanding side walls and a sealed gable top, the form, fill and seal packaging machine having a drive element and plurality of discrete package carriers for conveying the packages along a conveyance path through the packaging machine, the bulge reducer comprising:

a drive member operably connected to the machine drive element;

a reciprocating member operably connected to the drive member, the reciprocating member reciprocating toward and away from the conveyance path to contact one of the package side walls as the packages move along the conveyance path, wherein the reciprocating member contacts the package side wall to exert an inward force on and urge the side wall inwardly of the package; and a sprocket operably engaged with the drive element for rotating the sprocket, the sprocket including a cam element mounted thereto and operably connected to the reciprocating member, such that rotation of the cam element moves the cam element to reciprocate the reciprocating member.

2. The bulge reducer in accordance with claim 1 wherein the reciprocating member includes a roller element for contacting the package side wall.

3. The bulge reducer in accordance with claim 1 wherein the reciprocating element includes a roller for engagement with the cam element, such that rotation of the cam element moves the cam element into contact with the roller to reciprocate the reciprocating member.

4. The bulge reducer in accordance with claim 3 wherein the reciprocating member includes a roller element for contacting the package side wall.

5. The bulge reducer in accordance with claim 1 wherein the reciprocating element is biased away from the conveyance path.

6. The bulge reducer in accordance with claim 1 including a pressure platen opposite the reciprocating element relative to the conveyance path.

7. A form, fill and seal packaging machine of the type for forming a carton having a sealed bottom wall and upstanding side walls, filling the carton with a product and sealing a top of the carton to form a sealed gable top, comprising:

a drive element;

a conveyor operably connected to the drive element for moving a plurality of cartons through stations of the machine including a filling station, and a top sealing station, the conveyor including a plurality of carton carrying elements; and a carton bulge reducer disposed at the top sealing station, the bulge reducer including a drive member operably connected to the machine drive element, a reciprocating member operably connected to the drive member, the reciprocating member reciprocating toward and away from the conveyance path to contact one of the package side walls as the packages move along the conveyance path, wherein the reciprocating member contacts the package side wall to exert an inward force on and urge the side wall inwardly of the package when the package is at the top sealing station; and a sprocket operably engaged with the drive element for rotating the sprocket, the sprocket including a cam element mounted thereto and operably connected to the reciprocating member, such that rotation of the cam element moves the cam element to reciprocate the reciprocating member.

8. The packaging machine in accordance with claim 7 wherein the reciprocating member includes a roller element for contacting the package side wall.

9. The packaging machine in accordance with claim 7 wherein the reciprocating element includes a roller for engagement with the cam element, such that rotation of the cam element moves the cam element into contact with the roller to reciprocate the reciprocating member.

10. The packaging machine in accordance with claim 9 wherein the reciprocating member includes a roller element for contacting the package side wall.

11. The packaging machine in accordance with claim 7 wherein the drive element is a station chain and wherein the drive member is a sprocket operably engaged with the station chain for rotating the sprocket.

12. The packaging machine in accordance with claim 7 wherein the reciprocating element is biased away from the conveyance path.

13. The packaging machine in accordance with claim 7 including a pressure platen opposite the reciprocating element relative to the conveyance path.

14. The packaging machine in accordance with claim 7 wherein the reciprocating member reaches an inner most extension toward the conveyance path substantially corresponding to a central location of a respective carton carrying member.

* * * * *